US009166264B2

(12) United States Patent
Bao

(10) Patent No.: US 9,166,264 B2
(45) Date of Patent: Oct. 20, 2015

(54) DUAL MODE FILTER

(75) Inventor: Mingquan Bao, Vastra Frolunda (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 217 days.

(21) Appl. No.: 14/005,612

(22) PCT Filed: Mar. 22, 2011

(86) PCT No.: PCT/EP2011/054287

§ 371 (c)(1),
(2), (4) Date: Sep. 17, 2013

(87) PCT Pub. No.: WO2012/126513

PCT Pub. Date: Sep. 27, 2012

(65) Prior Publication Data

US 2014/0015625 A1 Jan. 16, 2014

(51) Int. Cl.
*H01P 1/203* (2006.01)
*H01P 1/20* (2006.01)

(52) U.S. Cl.
CPC ..... *H01P 1/20* (2013.01); *H01P 1/2039* (2013.01); *H01P 1/203* (2013.01)

(58) Field of Classification Search
CPC ..... H01P 1/203; H01P 1/20345; H01P 7/005; H01P 7/082
USPC ..... 333/204, 205, 219, 235
See application file for complete search history.

(56) References Cited

U.S. PATENT DOCUMENTS 6,326,865 B1 * 12/2001 Kundu et al. ..... 333/202

OTHER PUBLICATIONS

Evangelista, et al. "Analysis of the perturbation's size and the feeding topology on the dual-mode resonator in microstrip structure using FDTD", Microwave and Optpelectronics, 2005 SBMO/IEEE MTT-S International Conference on Jul. 2005, Piscataway, NJ, USA, IEEE, Jul. 20, 2005, pp. 474-476, XP010885262.

Konpang, "A dual-mode wide-band bandpass filter using slotted patch resonator with tuning stubs", Microwave Conference, 2008. APMC 2008. Asia-Pacific, IEEE, Piscataway, NJ, USA, Dec. 16, 2008, pp. 1-4, XP031636763.

Konpang, "A wide-band bandpass filter using the properties of microstrip open-loop resonator with spurious response suppression", Microwave Conference, 2008. APMC 2008. Asia-Pacific, IEEE, Piscataway, NJ, USA, Dec. 16, 2008, pp. 1-4, XP031457904.

* cited by examiner

*Primary Examiner* — Robert Pascal
*Assistant Examiner* — Gerald Stevens
(74) *Attorney, Agent, or Firm* — Rothwell, Figg, Ernst & Manbeck, P.C.

(57) ABSTRACT

A dual mode filter (200, 500, 900) comprising an input (Pin) and an output port (Pout) and a non-conducting substrate (205, 505), and first (215, 510, 902) and second (210, 540, 901) conductors which connect the input port to the output port. The conductors are arranged on or in the substrate, and the first conductor is longer than the second conductor by 50%. Either the first or the second conductor comprises a perturbation element (208, 530, 915) at a central position. The first conductor is arranged between the input port and the output port with a number of sections (216-222; 511-519; 931-933, 936-938), at least some of which are parallel to each other, and arranged so that the current in a section which has one or more other sections in parallel to it always flows in the same direction as the current in the most adjacent of said other sections.

6 Claims, 8 Drawing Sheets

DUAL MODE FILTER

CROSS REFERENCE TO RELATED APPLICATION(S)

This application is a 35 U.S.C. §371 National Phase Entry Application from PCT/EP2011/054287, filed Mar. 22, 2011, the disclosure of which is incorporated herein in its entirety by reference.

TECHNICAL FIELD

The present invention discloses an improved dual mode filter.

BACKGROUND

Dual mode filters are widely used in different kinds of microwave systems, for instance in such systems as high data-rate communication systems, high resolution radars, etc. In such systems, an important parameter is compact size.

In a dual-mode filter, two orthogonal modes occur at a resonator frequency. A conventional dual mode filter comprises a substrate of a non-conducting material, on which two conductors ("lines") extend between an input and an output port of the filter, with one of the lines being longer than the other. One of the two conductors is made to comprise a so called "perturbation element" in the middle of the conductor's extension between the input and the output port, in order to get the dual mode effect, which is also obtained due to the difference in lengths of the two conductors.

Often, the two conductors are designed to meander on the substrate, in order to shrink the total area of the substrate. However, a drawback of a meandering design is insertion losses and the surface area necessary for the dual mode filter.

SUMMARY

It is an object of the present invention to obtain a dual mode filter which obviates at least some of the disadvantages of previously known dual mode filters, in particular with respect to the area necessary for the filter.

Such a dual mode filter is disclosed by the present invention by means of a dual mode filter which comprises an input port and an output port, and which also comprises a substrate of a non-conducting material and a first and a second conductor.

Both of the conductors connect the input port to the output port, and the first and the second conductors are arranged on or in the substrate. The first conductor is longer than the second conductor by at least 50%, and either the first or the second conductor comprises a perturbation element at a central position of the conductor.

In the dual mode filter, the first conductor is arranged between the input port and the output port with a number of sections, at least some of which are parallel to each other. The sections are arranged so that the current in the two most adjacent parallel sections always flows in the same direction.

Due to the arrangement of the sections of the first (longer) conductor, as will be shown in more detail in the detailed description, a coupling is obtained which enables the size of the dual mode filter to be reduced as compared with previously known dual mode filters.

In embodiments of the dual mode filter, the first conductor is arranged between the input and the output port in such a manner that the first conductor exhibits at least one crossing of two of its sections, with the crossing being accomplished by means of vias in at least one of the two sections.

In embodiments, the dual mode filter additionally comprises at least one further conductor which extends on or in the non-conducting substrate separated in the substrate from the first and second conductors, arranged symmetrically in the filter with respect to a line of symmetry through a centre of extension of the first and/or second conductors, and overlaps at least two of the sections of the first conductor.

Such a further (overlapping) conductor has a capacitive (i.e. non-galvanic) coupling to the sections of the first conductor which it overlaps, which is highly beneficial, as will also be shown in the detailed part of this description.

In embodiments of the dual mode filter, sections of the first conductor are arranged into a first and a second group, with the groups being connected to each other by one of the sections.

In embodiments of the dual mode filter, the first and second conductors are conductors in microstrip lines.

In embodiments of the dual mode filter, the first and second conductors are conductors in strip line technology.

In embodiments of the dual mode filter, the first and second conductors are conductors in coplanar waveguides.

BRIEF DESCRIPTION OF THE DRAWINGS

The invention will be described in more detail in the following, with reference to the appended drawings, in which.

DETAILED DESCRIPTION

Figure 1:
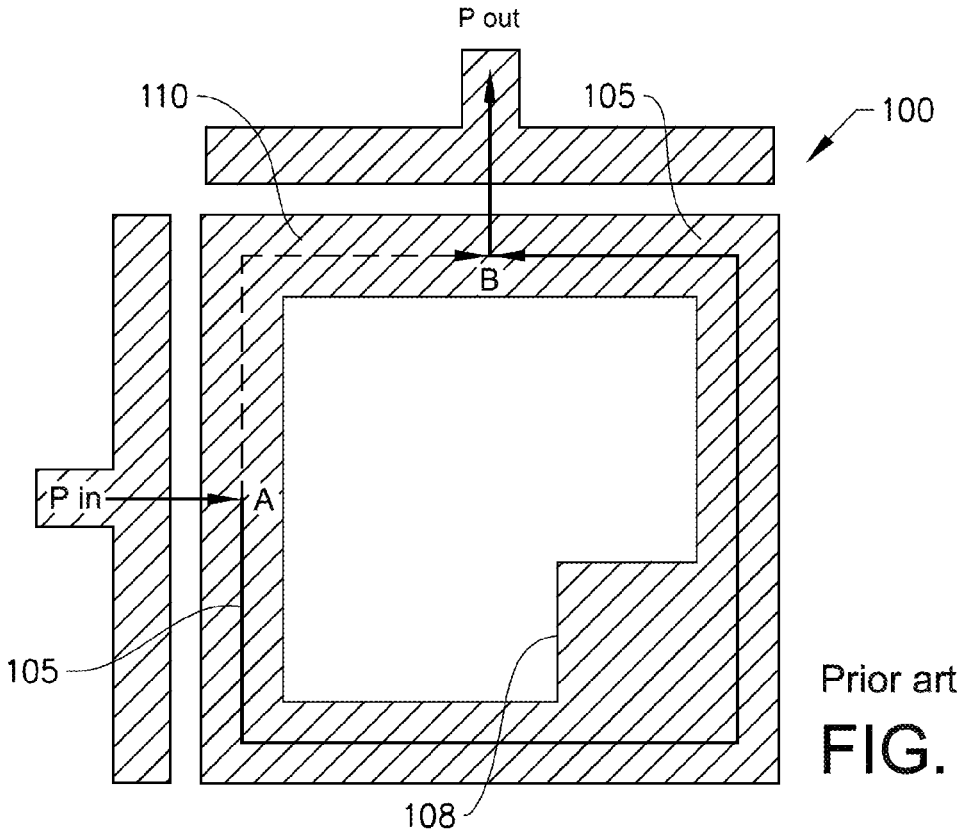
Prior art FIG. 1
FIG. 1 shows a prior art dual mode filter.

Embodiments of the present invention will be described more fully hereinafter with reference to the accompanying drawings, in which embodiments of the invention are shown. The invention may, however, be embodied in many different forms and should not be construed as being limited to the embodiments set forth herein. Like numbers in the drawings refer to like elements throughout.

The terminology used herein is for the purpose of describing particular embodiments only, and is not intended to limit the invention.

FIG. 1 shows an example of a traditional prior art dual mode filter 100. As shown, the dual mode filter 100 comprises an input port, Pin, and an output port, Pout. The filter 100 also comprises a substrate (not shown in FIG. 1) of a non-conducting material, on or in which a first conductor 105 and a second conductor 110 are arranged. The first and the second conductors extend in the filter, on or in a (not shown) substrate of a non conducting material, and connect the input port Pin to the output port Pout. One of the conductors is longer than the other, usually by a factor three, as shown in FIG. 1, or more, but in other embodiments sometimes down to as little as 50%. In the example shown in FIG. 1, it is the conductor 105 which is the longer. The direction of an input current in the first 105 and second 110 conductors is indicated by means of arrows.

In the dual mode filter 100, there is comprised a so called perturbation element 108 in the dual mode filter 100. The perturbation element 108 is located at the centre point, i.e. centrally between the input and output ports, of one of the two conductors, usually the longer conductor 105. The exact nature of the perturbation element can vary, and will be described in more detail later in this text.

In the dual mode filter 100, two so called degenerate resonant modes resonate at respective (different) resonance frequencies due to the presence of the perturbation element. These two modes couple to each other, and make the design 100 form a bandpass filter.

Although one port in FIG. 1 has been indicated as input port and the other port has been indicated as output port, it should be pointed out that the embodiment of FIG. 1 can also be used in the other direction, i.e. with an input signal at the port which is indicated as output port, and an output signal being retrieved at the port which is indicated in FIG. 1 as input port. This principle is true for a dual mode filter of the invention in general, i.e. that the filter is "reciprocal" in that an input signal can be applied at either the port denoted as input port or at the port denoted as output port, and that an output signal can then be retrieved at the other port. However, for ease of description, in this description and in the drawings, one port will be denoted as Pin and the other port will be denoted as Pout.

Figure 2:
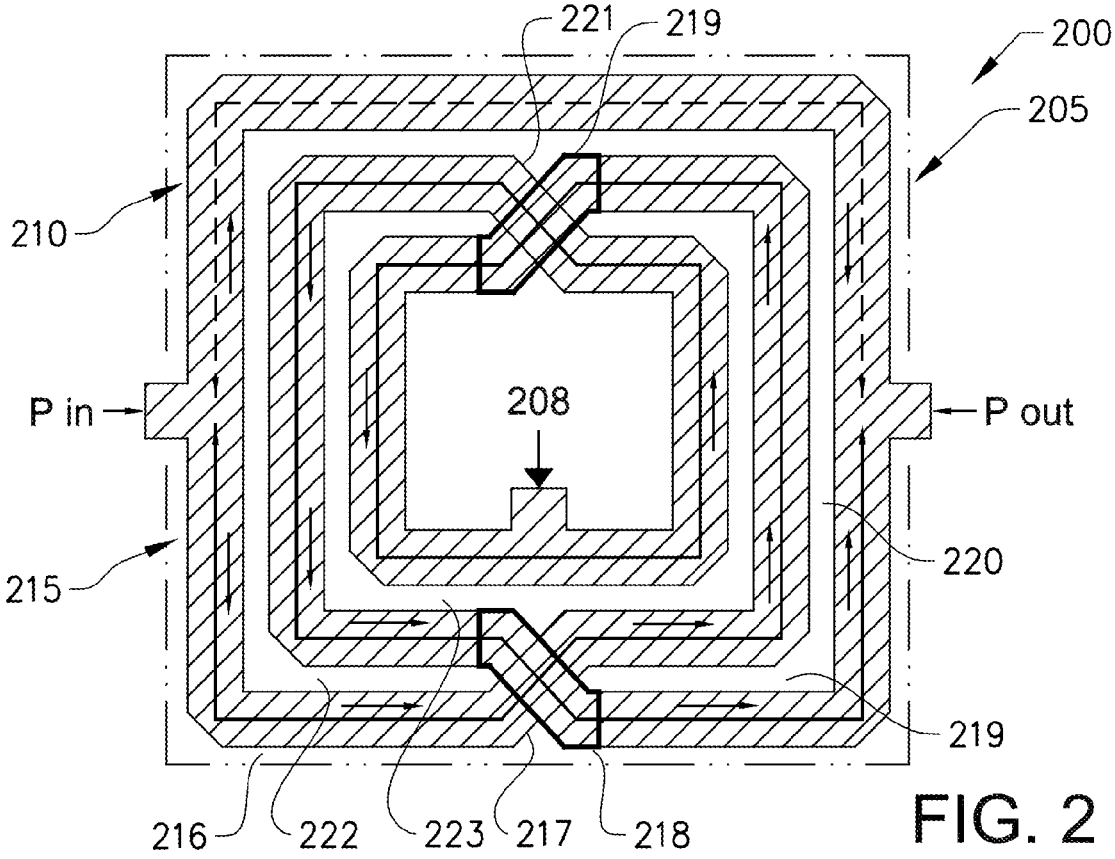
FIG. 2 shows a first embodiment of the invention.

FIG. 2 shows a first embodiment 200 of a dual mode filter of the invention, where the position of the (not explicitly shown in FIG. 2) perturbation element is shown by means of an arrow 208. The embodiment 200 comprises an input port Pin and an output port Pout, and also comprises a substrate 205 of a non-conducting material.

In addition, the embodiment 200 comprises a first 215 and a second 210 conductor, both of which conductors 215, 210 connect the input port Pin to the output port Pout. The direction of an input current is shown by means of arrow in the conductors 215 and 210.

The first 215 and the second 210 conductors are arranged on or in the substrate, and as can be seen in FIG. 2, the first conductor 215 is longer than the second conductor 210. The difference in length between the conductors should be 50% or more, with the difference in the embodiment 200 of FIG. 2 being more than 50%.

In the embodiment 200, the first conductor 215 has an extra port 208, which will be connected to a (not shown) perturbation element at a central position of the conductor, i.e. at a position halfway between the first conductor's extension between the input and output port. In this embodiment, the perturbation element is positioned at the point 208, and can, for example, comprise lumped reactive components, such as, for example an inductor in parallel with a capacitor, i.e. a so called LC circuit.

As shown in FIG. 2, conductors 210, 215 are as a whole arranged to occupy a generally "square" area on or in the substrate 200, which is only an example of one suitable embodiment. The second conductor 210 is arranged on the perimeter of the square, and comprises three separate essentially straight sections to this end.

The first conductor 215 is arranged between the input port Pin and the output port Pout, and comprises a number of sections, which in the embodiment of FIG. 2 are essentially straight. In FIG. 2, not all of the sections of the first conductor 215 have been numbered, for the sake of clarity in the drawing. However a number of sections in the first conductor 215 have been numbered as 216, 217, 218, 219, 220, 221, 222 and 223 in FIG. 2.

As can be seen, within the square occupied by the conductors 210, 215 on or in the substrate 205, at least some of the sections of the first conductor 215 are parallel to each other, such as the sections 216, 222 and 223. The sections in the first conductor 215 are arranged so that the current in the two most adjacent parallel sections always flows in the same direction. As can be seen, in the embodiment 200 of FIG. 2, all parallel sections of the first conductor are arranged equidistantly, which need not however be the case, as will be shown in other embodiments in this description. The direction of the flow of the current in the conductors 210, 215 is indicated by means of arrows in FIG. 2.

As shown in the embodiment of FIG. 2, suitably the first conductor 215 is arranged between the input port Pin and the output port Pout in such a manner that the first conductor 215 exhibits at least one crossing of two of its sections, which in the case of the embodiment of FIG. 2 occurs for sections 217 and 218 as well as sections 219 and 221.

The crossings of two sections in the first conductor 215, such as sections 217 and 218 as well as sections 219 and 221, is suitably accomplished by means of vias in at least one of the two crossing sections. By means of vias, a section can be altered "in height", i.e. the level within the non-conducting substrate which the section occupies, so that the section may cross the other section without any mechanical contact occurring between the two crossing sections.

By means of the current's direction in the most adjacent parallel sections, a coupling is obtained between the most adjacent parallel sections, by means of which an effective dielectric constant is obtained which is larger than that of a single section. This means that for a given electrical length, the physical length of the coupled conductors is smaller than for a single "non coupled" conductor, which in turn leads to a dual mode filter with a smaller size (surface area) than previously know dual mode filters. The reasons for this advantageous effect will now be explained with reference to FIGS. 3*a*-3*c* and FIG. 4, and using microstrip lines as conductors.

Figure 3A:
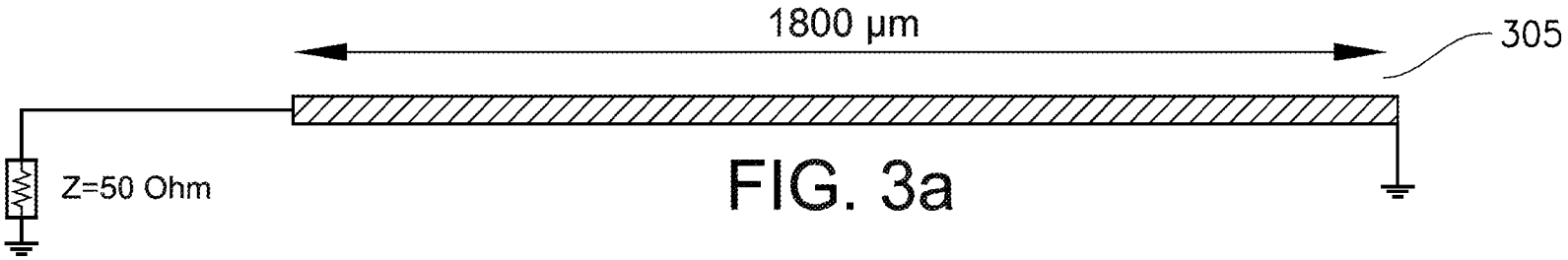
FIGS. 3*a*-3*c* and 4 illustrate a principle utilized by the invention.
Figure 3B:
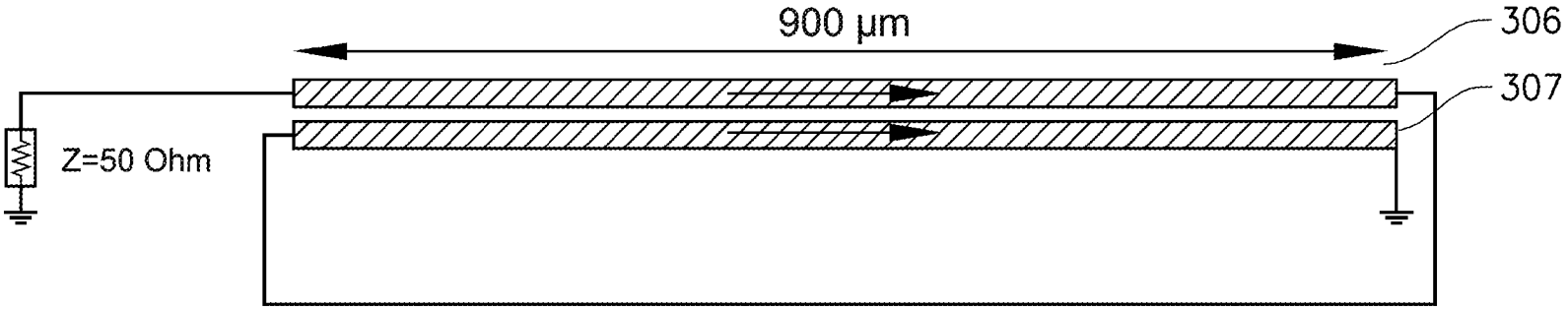
Figure 3C:
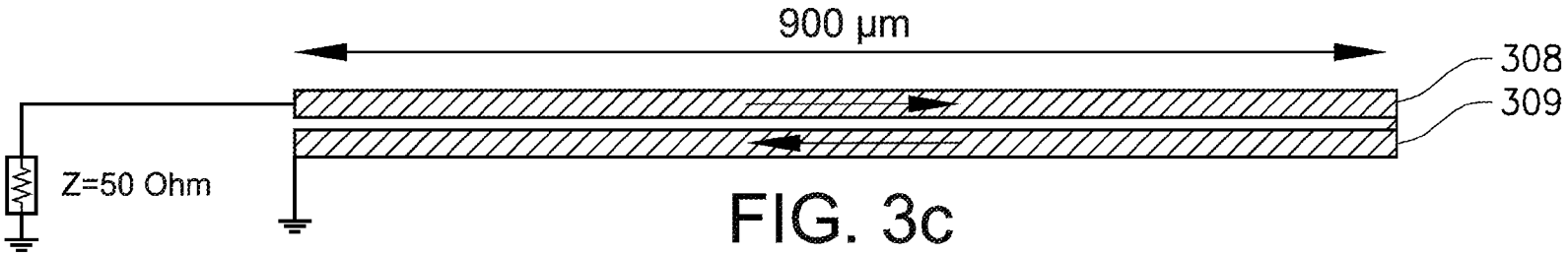

At first, the effect of the current direction on the coupling of conductors is demonstrated, with reference to FIGS. 3*a*-3*c*: Three different microstrip conductors, each having a grounded terminal, are built on a GaAs substrate (not shown in FIGS. 3*a*-3*c*). The three microstrip conductors are an 1800 um length line 305, shown in FIG. 3*a*, two 900 um parallel lines 306, 307 with the same current direction, shown in FIG. 3*b*, and two 900 um parallel lines 308, 309 with opposite current directions, shown in FIG. 3*c*.

All of the conductors in FIGS. 3*a*-3*c* have a width of 40 um, and the distance between the parallel lines of FIGS. 3*b* and 3*c* is 15 um. The input impedance Z of the conductors in FIGS. 3*a*-3*c* as a function of the frequency is shown in FIG. 4, with Z(1,1) referring to the conductor of FIG. 3*a*, Z(2,2) referring to the conductor of FIG. 3*b* and Z(3,3) referring to the conductor of FIG. 3*c*.

Figure 4:
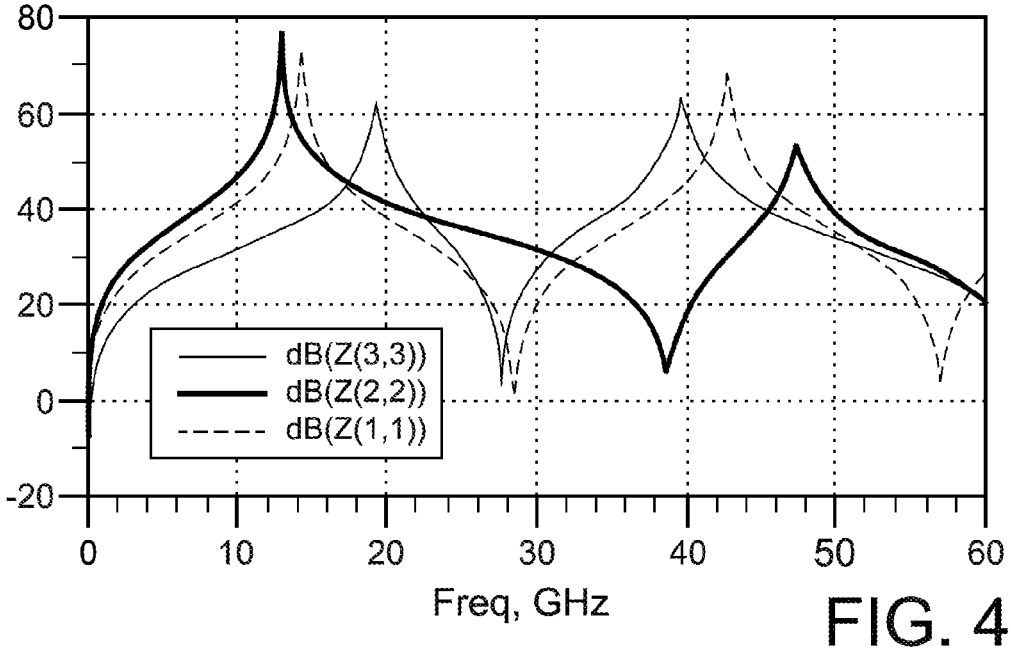

It can be found from the diagrams of FIG. 4 that even though the total physical length of the conductors in FIGS. 3*a*-3*c* line is the same, i.e. 1800 μm, the first impedance peak corresponding to a quarter wavelength, $\lambda_g/4$, (electrical length $\theta=\pi/2$) is located at different frequencies for the conductors in FIGS. 3*a*-3*c*. Using those frequencies, it can be shown that for one and the same frequency, the electrical length of two coupled conductors with current running in the same direction is 1.1, i.e. 10% larger, than that of a single conductor, and the electrical length of two coupled conductors with opposite current directions is 0.74 of that of a single conductor. This effect can be utilized in order to obtain a dual mode filter with reduced size (surface area).

Figure 5:
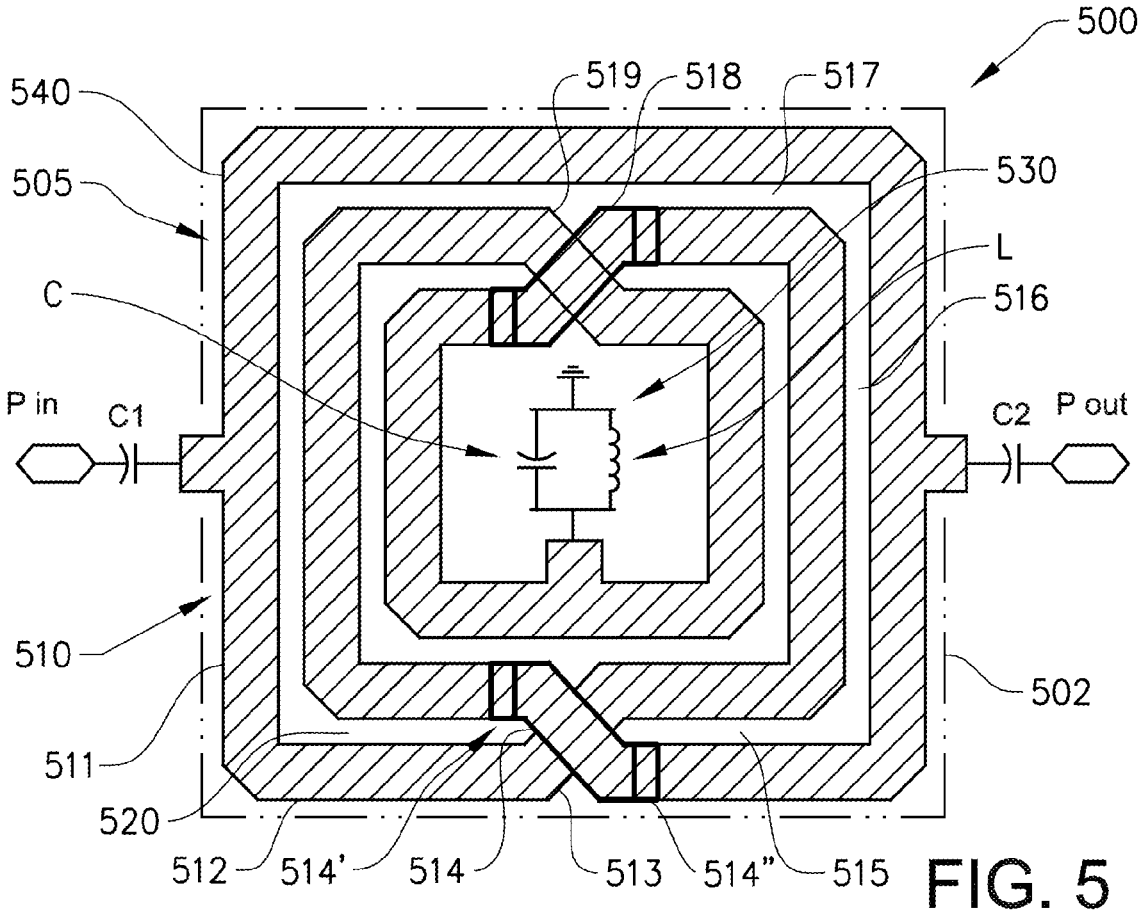
FIG. 5 shows a modification of the embodiment of FIG. 2.

FIG. 5 shows a modification of the embodiment of a dual mode filter from FIG. 2, which will be used to explain the invention further. The dual mode filter of FIG. 5 is numbered 500. The embodiment also comprises a first capacitor C1 at the input port Pin and a second capacitor C2 at the output port Pout. The capacitors C1 and C2 are suitably but necessarily of the same dimension.

As can be seen in FIG. 5, the dual mode filter 500 comprises two conductors arranged on or in a non conducting substrate 502, a "shorter" conductor 505 and a "longer" conductor 510. The difference in length between the two conductors 505, 510 is obtained by means of "winding up" the longer conductor 510, as shown in FIG. 5, so that the longer conductor 510 comprises a number of sections, at least some of which are parallel to each other, with the sections being arranged so that the current in a section which has one or more other sections in parallel to it always flows in the same direction as the current in the most adjacent of the other parallel sections. Some sections in the longer conductor 510 have been numbered as 511-519 in FIG. 5. Examples of neighbouring sections with parallel current directions are sections 512 and 520.

As also shown in the view in FIG. 2, the dual mode filter 500 comprises two "crosses" in the longer conductor 510: in a first crossing, sections 514 and 513 cross each other, and in a second crossing, sections 518 and 519 cross each other. As clarified in FIG. 5, in the first crossing, the crossing of sections 513 and 514, is accomplished by means of vias in section 514, at locations marked 514' and 514" in FIG. 5. The vias are used to reach a different layer in the non conducting substrate (above or below section 513), at which layer section 514 is arranged. This can also be seen as using vias at 514' and 514" to reach a "bridge" 514 which passes by section 513 in a different layer in the non-conducting substrate 502. The same technique is used at the crossing of sections 518 and 519.

Also shown in FIG. 5 are the input port Pin and the output port Pout of the dual mode filter 500, each of which has a capacitance arranged at it, $C_1$ at Pin and $C_2$ at Pout. The role of the capacitances C1 and C2 is to filter out low frequency signals. As an example only, a suitable value for C1 and C2 is 0.45 pF.

A perturbation element 530 of the dual mode filter 500 is also shown in FIG. 5: in this embodiment, the perturbation element 530 comprises a grounded LC resonator comprising a capacitor C and an inductor L connected in parallel to each other.

A suitable choice of material for the non conducting substrate for the dual mode filters 200 and 500 is GaAs, and in one exemplary embodiment, a dual mode filter with a surface area of 0.54*0.54 mm was designed according to the principles shown in connection to FIGS. 2 and 5. In the exemplary embodiment, the width of the microstrip conductors was 40 μm, and the distance between two parallel sections in the longer conductor was 15 μm.

Figure 6:
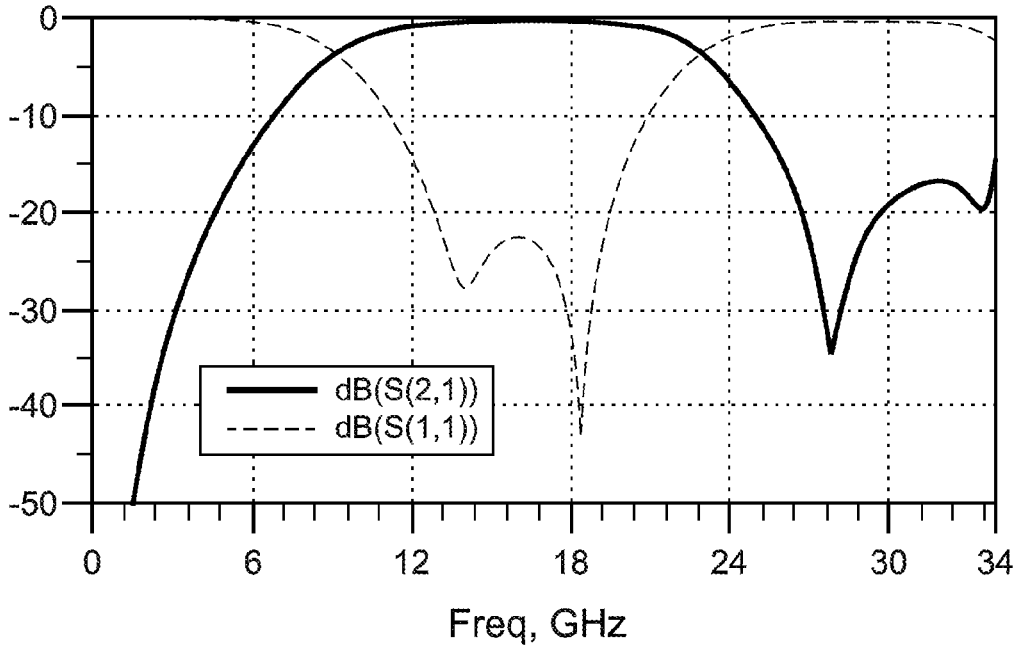
FIG. 6 shows S-parameters of the embodiment of FIG. 5.
Figure 7:
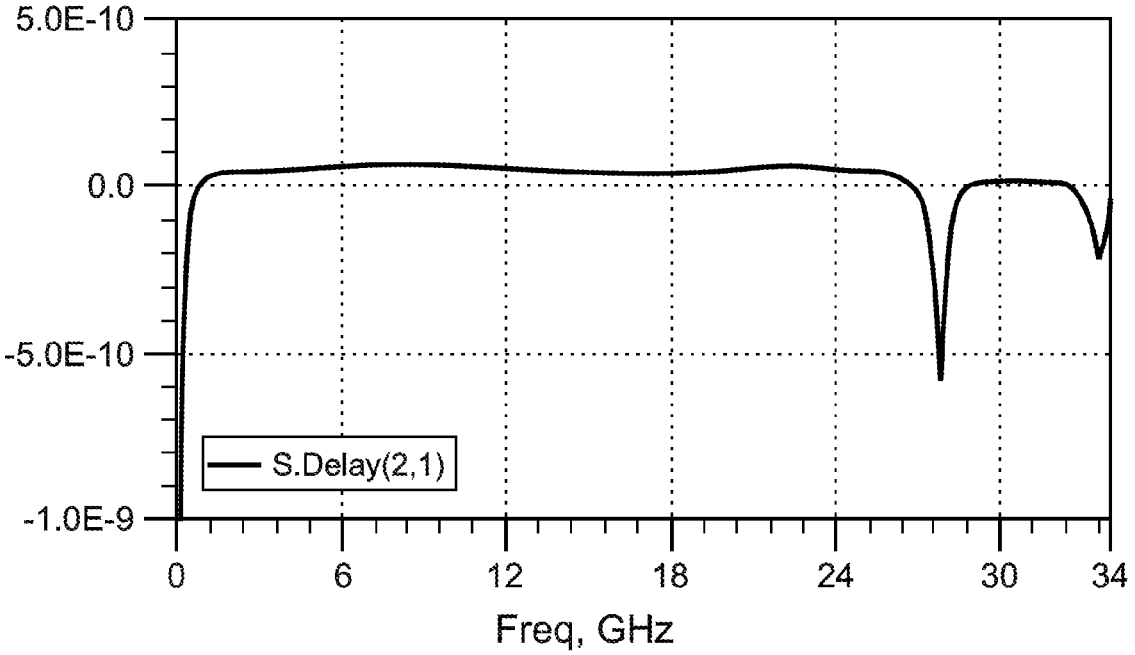
FIG. 7 shows the group delay of the embodiment of FIG. 5.

Using those parameters and the principles explained in connection with FIGS. 2 and 5, a dual mode band pass filter was obtained which has a centre frequency of 16.5 GHz and a 3 dB bandwidth of 12.4 GHz. The S-parameters of that filter are shown in FIG. 6, where the numeral 2 refers to the output port Pout, and the numeral 1 refers to the input port Pin. As seen in FIG. 6, the filter has a small insertion loss and good input matching in the pass band. FIG. 7 shows the group delay of the dual mode band pass filter. As can be seen, a flat group delay within the pass band of the dual mode band pass filter is obtained.

Figure 8:
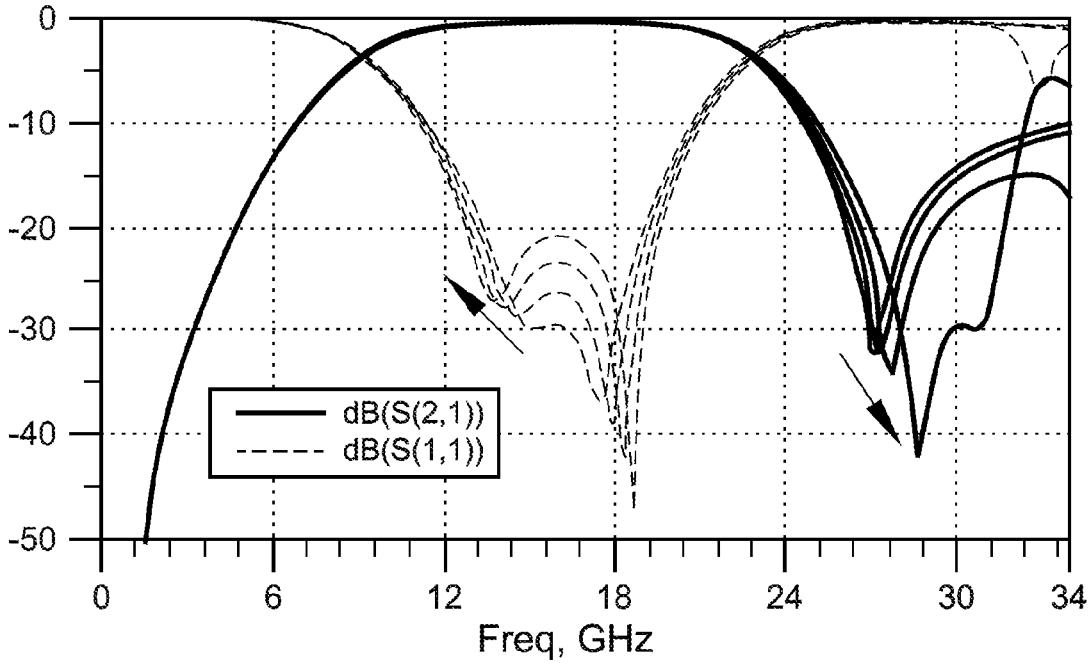
FIG. 8 shows S-parameters of the embodiment of FIG. 5 with varied perturbation elements.

In similarity to prior art dual-mode microstrip filters, the center frequency, as well as the 3-dB bandwidth, of the dual mode band pass filter obtained in the manner describe above can be tuned by varying the length of conductor 505 and 510, as well as varying the capacitance and/or inductance of the perturbation element 530. As the LC resonator's capacitance and/or inductance is changed, the filter's parameters S11 and S21 will also vary, where S11 is defined as the input reflection coefficient at port 1 and S21 as the forward transmission coefficient between port 1 and port 2. For example, if the capacitance of perturbation element (i.e. the LC resonator) is changed from 0.1 pF to 0.3 pF, the S-parameter which is obtained is shown in FIG. 8, where the arrows indicate the direction of increasing capacitance.

Figure 9:
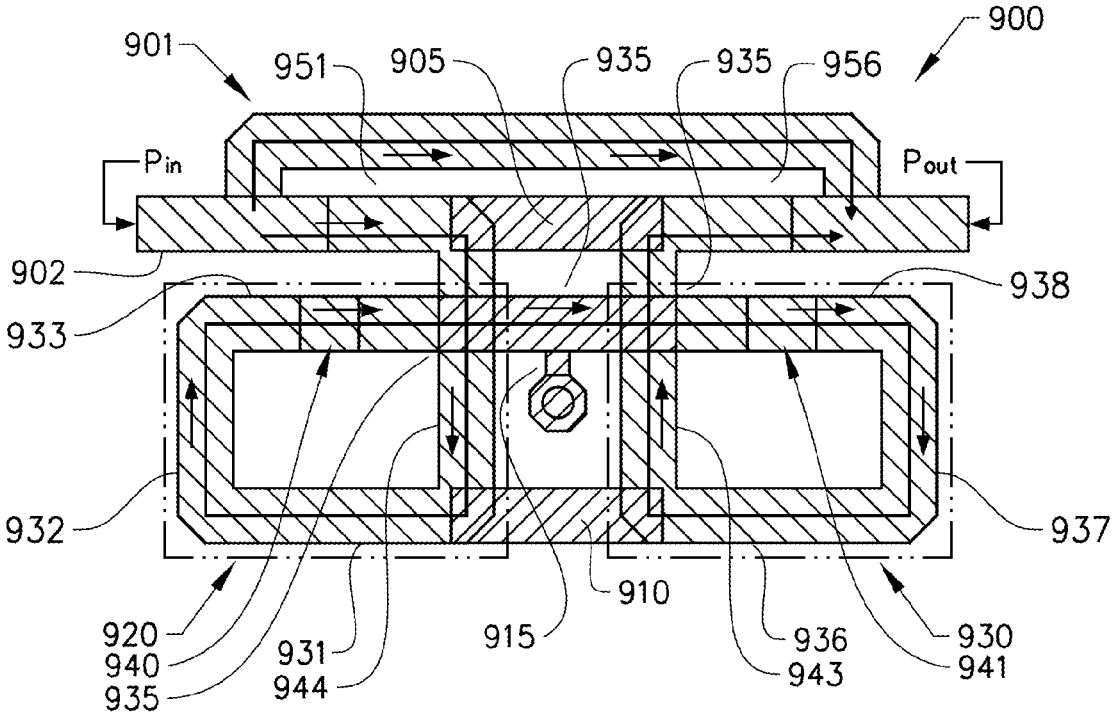
FIG. 9 shows a second embodiment of the invention.

In yet a further embodiment 900 of the dual mode filter of the invention, which is shown in FIG. 9, some of the sections of a first conductor 902 are arranged into a first 920 and a second 930 group, indicated by a frame of dashed lines in FIG. 9. The second group 930 comprises sections 936, 937, 938 and 943, and the first group 920 comprises sections 931, 932, 934 and 944.

As can be seen in FIG. 9, the sections of the two groups 920, 930, are arranged into squares or rectangles, and the two groups 920, 930, are connected to each other by a section 935 of the first conductor. The connecting section 935 exhibits vias in the non-conducting substrate (not shown in FIG. 9) of the dual mode filter 900, at positions indicated as 940 and 941 in FIG. 9, by means of which vias the connecting section 935 is positioned at a different layer of the non-conducting substrate than the sections which it crosses, so that a "non-touching" crossing is obtained. The connecting section 935 can also be seen as a section which is common to both of the groups 920, 930 of sections in the first conductor 902.

Regarding the second or "shorter" conductor 901 of the embodiment 900, this conductor, as shown in FIG. 9, is essentially straight, and branches away from the first conductor 902 at a point just after the input port Pin, and reconnects with the first conductor 902 at a point just before the output port Pout.

Turning now to the perturbation element 915 of the embodiment 900, this is realized as a shunted capacitor of 0.38 pF, which has one terminal connected to ground by means of a via connector, and the other terminal is connected to a middle point of the first conductor 902, where the term "middle point" is defined as a point in the middle of the first conductor's extension between the input port Pin and the output port Pout.

The entire area occupied by one design of the dual mode band pass filter 900 is 1.0*0.52 $mm^2$.

As mentioned, the connecting section 935 occupies a different layer in the non-conducting substrate with respect to the first conductor 902. In the same layer as the connecting section 935, or in a different layer which is also separate from that of the second conductor, there are arranged two additional conductors, indicated as 905 and 910. The additional or extra conductor 910 overlaps sections 931 and 936 of the first conductor, and the additional or extra conductor 905 overlaps sections 951 and 956 of the first conductor. In one embodiment of the dual mode filter 900, these two conductors 905 and 910 are realized as microstrip lines. The function of these two conductors will be explained in detail later in this text.

Figure 10:
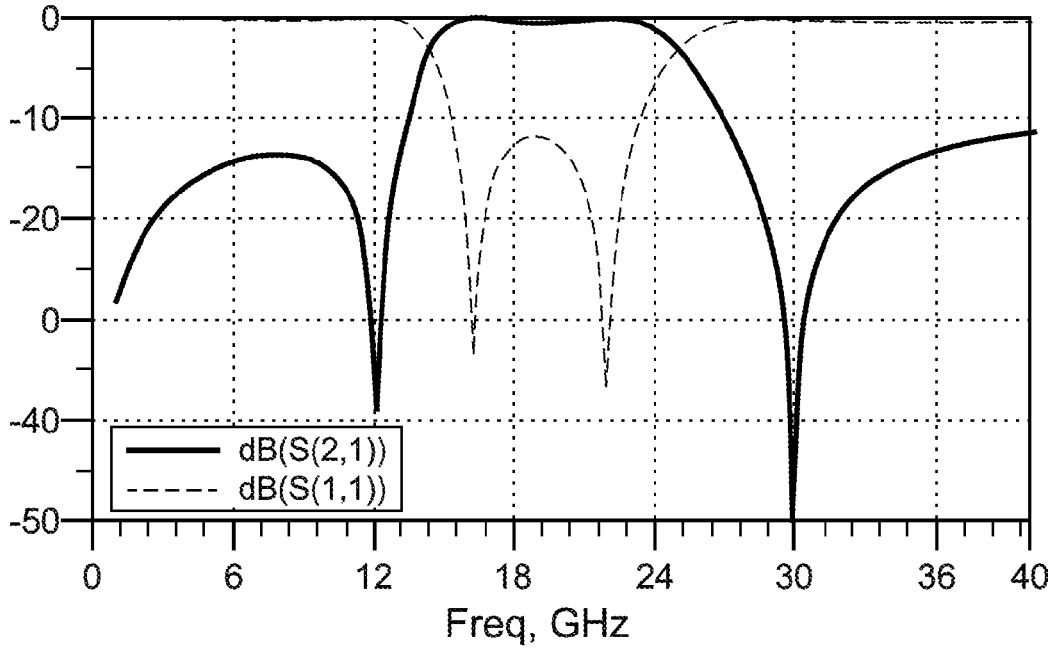
FIG. 10 shows S-parameters of the embodiment of FIG. 9.
Figure 11:
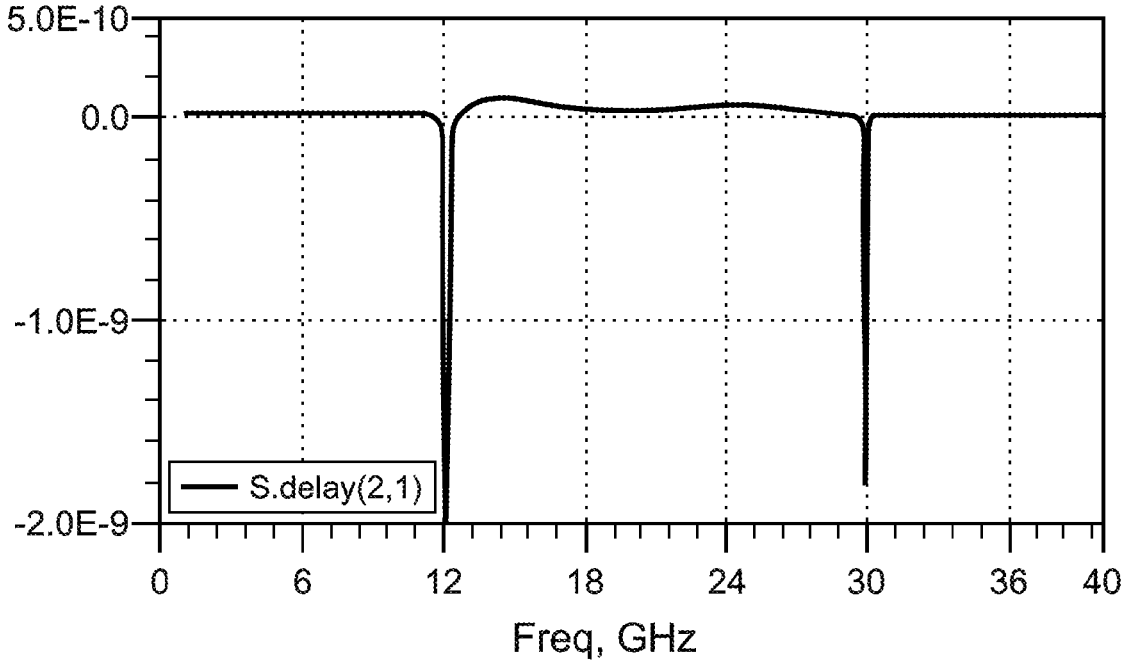
FIG. 11 shows the group delay of the embodiment of FIG. 9.

The S-parameters of the dual mode filter 900 are shown in FIG. 10: as can be seen in FIG. 10, the filter 900 has a pass band which is centred at 19.3 GHz, with a 3 dB bandwidth of 10.5 GHz. FIG. 11 show the group delay of the dual mode filter 900: as can be seen in FIG. 11. It can be seen that the variation of the group delay with the 3 dB band pass frequencies is quite small. This is a desired feature for a band pass filter. However, large variations of the group delay occur at the transmission zero of S21.

Figure 12:
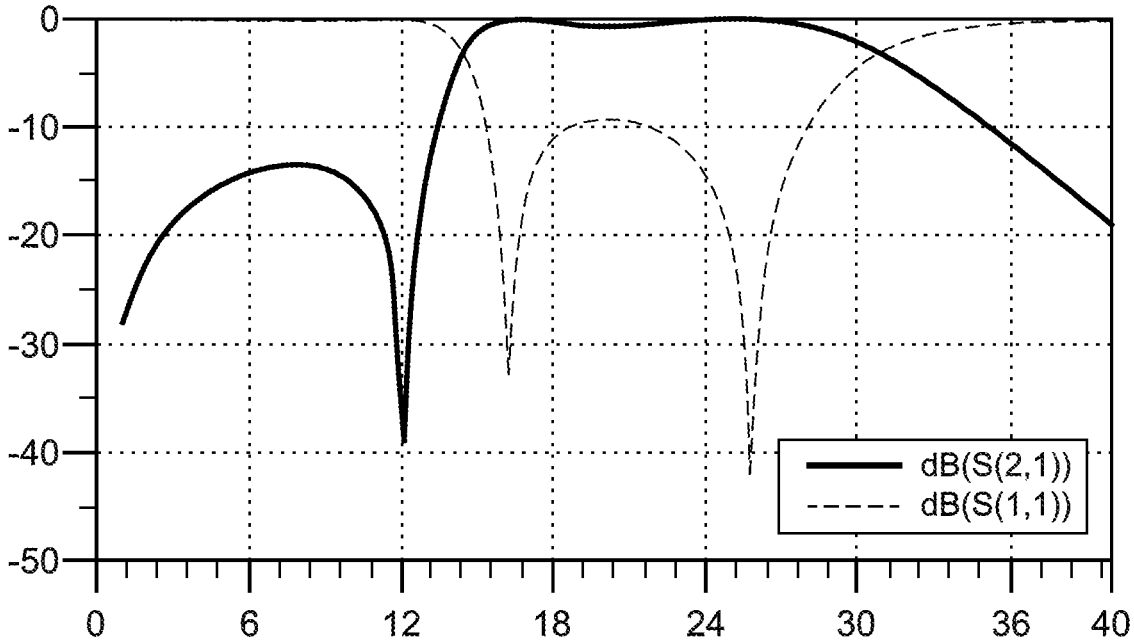
FIG. 12 shows S-parameters of a version of the embodiment of FIG. 9.
Figure 13:
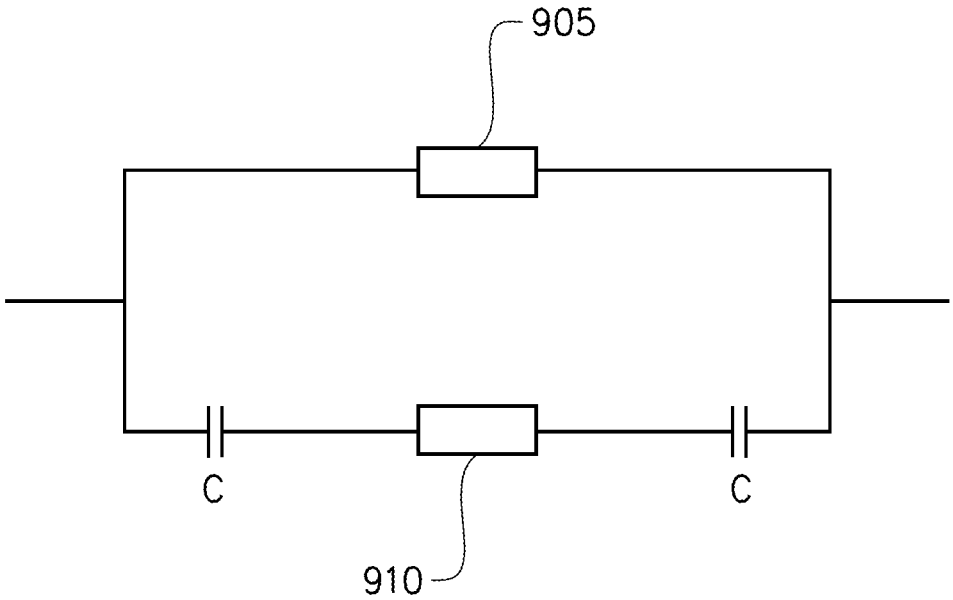
FIG. 13 shows an equivalent circuit for paths in the embodiment of FIG. 9.
Figure 14:
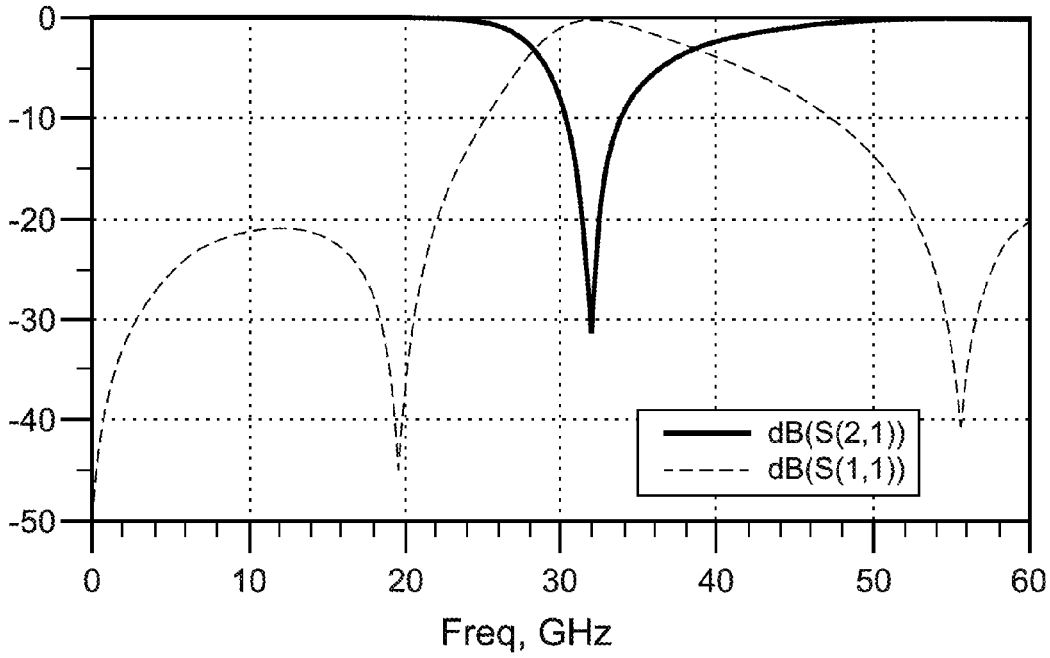
FIG. 14 shows S-parameters of the circuit of FIG. 13.

Returning now to function of the two conductors 905 and 910, FIG. 12 shows the S-parameters of the dual mode filter 900 in FIG. 9 without these two conductors. As can be seen in FIG. 12, the high frequency cut-off is not particularly sharp, and it can also be seen that the input impedance matching in the pass band also deteriorates. One way of improving the characteristics shown in FIG. 12 is to add an extra "transmission zero" in the upper stop band of the filter 900, thereby sharpening the cut-off rate, which is accomplished by means of the "extra conductors" 905 and 910, and the capacitive coupling that these extra conductors exhibit towards the portions of the first conductor 902 which they connect by means of overlapping them in a separate layer of the substrate. An equivalent circuit of the combination of conductor 902 and conductor 905 is shown in FIG. 13, which shows two (microstrip) conductors in parallel with each other, with a capacitor in series with each conductor. In the specific example of FIG. 9, the value of the capacitors is 65 pF. The S-parameters of the equivalent circuit of FIG. 13 are shown in FIG. 14, where it can be seen that there is a "transmission zero" at approximately 32 GHz.

The location of the transmission zero can be adjusted by varying the capacitances in FIG. 13, by means of varying the area of the sections of the conductor 902 which overlaps the conductor 905. In addition, the high frequency cut-off characteristics of the filter 900 can be improved (i.e. sharpened) by adding a further "extra" conductor which couples capacitively to the conductor 902, which is done by means of conductor 910 in FIG. 9.

It should be pointed out that an effect similar to that of using conductor 905 in conjunction with conductor 902 can also be obtained by means of using only one of conductors 905, 910 in conjunction with conductor 902. The exact effect of using one or both (or more than two) "extra" conductors such as conductors 905 and 910 which couple capacitively to conductor 902 is decided by the amount of overlap between the conductor 902 and the extra conductor/conductors.

Figure 15:
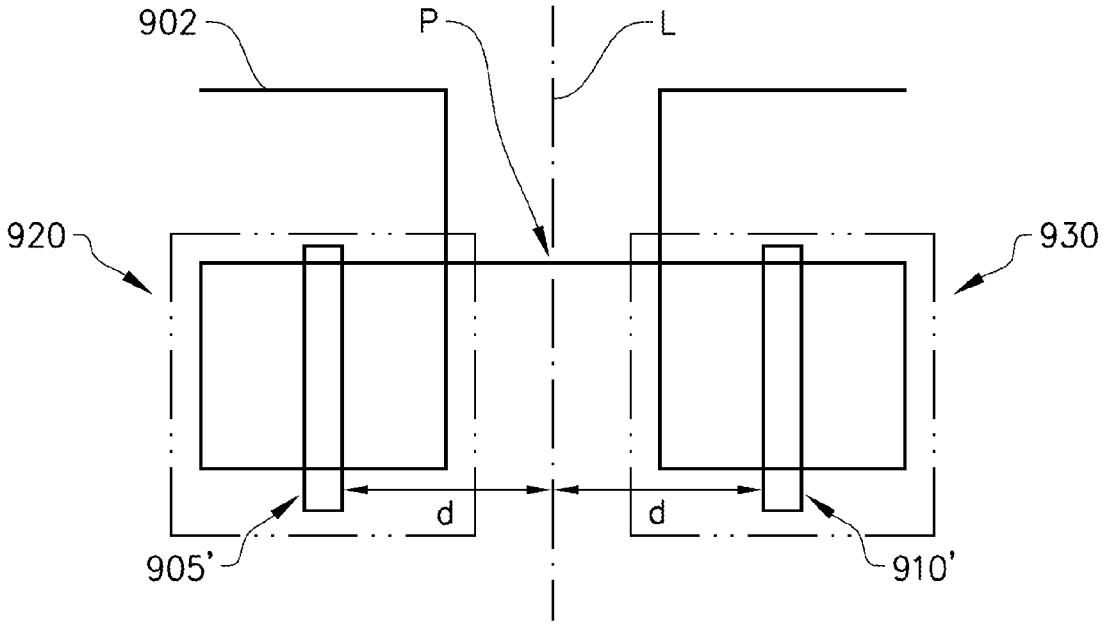
FIG. 15 shows a principle employed in the embodiment of FIG. 9.

FIG. 15 shows a principle which should be observed when using extra capacitors which couple capacitively to the first conductor 902: in FIG. 15, there is shown, schematically, the second conductor 902 with its two groups 920 and 930. Two "extra" capacitors 905' and 910' are also shown, positioned separately in the non conducting substrate, with an overlap to the first conductor 902, so as to obtain a capacitive coupling to the second conductor. The two "extra" capacitors 905' and 910' are positioned symmetrically in the filter with respect to a line of symmetry "L" through a centre "P" of the extension of the first conductor 905, overlapping at least two sections of the first conductor 902.

The same principle should be observed if, for example, only using one extra conductor, i.e. the extra conductor should overlap two sections of the second conductor, and extend through the "middle" or centre point of the second conductor.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation.

The invention is not limited to the examples of embodiments described above and shown in the drawings, but may be freely varied within the scope of the appended claims.

The invention claimed is:

1. A dual mode filter comprising an input port (Pin) and an output port (Pout), the dual mode filter also comprising a substrate of a non-conducting material and a first conductor and a second conductor, both of which first and second conductors connect the input port (Pin) to the output port (Pout), with the first and the second conductors being arranged on or in the substrate, the first conductor being longer than the second conductor by at least 50%, in which dual mode filter the first conductor comprises a perturbation element at a central position of the conductor, wherein the first conductor is arranged between the input port (Pin) and the output port (Pout) with a number of sections, at least some of which are parallel to each other, and in that the sections are arranged so that the current in the two most adjacent parallel ones of the sections always flows in the same direction, with the first conductor being arranged between the input port (Pin) and the output port (Pout) in such a manner that the first conductor exhibits at least one crossing of two of its sections, said at least one crossing being accomplished by means of vias in at least one of said two sections.

2. The dual mode filter of claim 1, additionally comprising at least one further conductor which extends on or in the non-conducting substrate separated in the substrate from the first and second conductors, arranged symmetrically in the dual mode filter with respect to a line of symmetry through a center of extension of the first and second conductors, and overlaps at least two of the sections of the first conductor.

3. The dual mode filter of claim 1, wherein some of the sections of the first conductor are arranged into a first and a second group, which first and second groups are connected to each other by one of the sections of the first conductor which crosses sections in the first and second group by means of the vias in the non conducting substrate.

4. The dual mode filter of claim 1, wherein the first and second conductors are microstrip lines.

5. The dual mode filter of claim 1, wherein the first and second conductors are strip lines.

6. The dual mode filter of claim 1, wherein the first and second conductors are co-planar waveguides.

* * * * *